US005921788A

United States Patent [19]

Wilson et al.

[11] Patent Number: 5,921,788

[45] Date of Patent: Jul. 13, 1999

[54] ELECTRICAL HEADER WITH IMPROVED POST RETENTION

[75] Inventors: Richard Dwayne Wilson, Greensboro; Patrick Andrew Phillips, Kernersville; Richard Devowe Hutchinson, Jr., Greensboro; Carlos Ruben Chavez, Burlington; Peter Gedde Nielsen, King, all of N.C.

[73] Assignee: The Whitaker Corporation, Wilmington, Del.

[21] Appl. No.: 08/844,288

[22] Filed: Apr. 18, 1997

[51] Int. Cl.[6] ..... H01R 13/40

[52] U.S. Cl. ..... 439/78; 439/733.1

[58] Field of Search ..... 439/733.1, 78

[56] References Cited

U.S. PATENT DOCUMENTS

| | | | |
|---|---|---|---|
| 4,035,047 | 7/1977 | Ammon | 439/733.1 |
| 4,464,007 | 8/1984 | Parmer | 439/733.1 |
| 4,575,176 | 3/1986 | Castello et al. | 339/195 M |
| 5,035,656 | 7/1991 | Patel | 439/78 |
| 5,108,317 | 4/1992 | Beinhaur et al. | 439/736 |
| 5,445,527 | 8/1995 | Martin | 439/78 |

FOREIGN PATENT DOCUMENTS

| | | |
|---|---|---|
| 0 806 814A2 | 11/1997 | European Pat. Off. . |
| WO 96/26558 | 8/1996 | WIPO . |

*Primary Examiner*—Gary Paumen
*Attorney, Agent, or Firm*—Robert Kapalka

[57] ABSTRACT

An electrical header comprises a dielectric housing having cavities and contact posts held in the cavities. The contact posts extend beyond a first face of the housing for attachment to a substrate and extend beyond a second face of the housing for engagement with contacts of a mating electrical connector. Each of the contact posts has an enlargement in a vicinity of the second face. Each of the enlargements has a width which is greater than a width of its corresponding cavity for preventing the housing from being pulled off of the contact posts when the contact posts are attached to the substrate.

7 Claims, 2 Drawing Sheets

ELECTRICAL HEADER WITH IMPROVED POST RETENTION

FIELD OF THE INVENTION

The invention relates to an electrical header having contact posts which are held in cavities in a housing.

BACKGROUND OF THE INVENTION

A friction lock electrical header which is sold under part number 640456 by AMP Incorporated of Harrisburg, Pa. comprises a plastic housing which holds contact posts that extend from opposite mating faces of the housing. Portions of the contact posts extending from one mating face can be soldered to plated through-holes in a circuit board. The housing itself is allowed to rest on the board but does not get directly attached to the board. Portions of the contact posts extending from the other mating face are matable with contacts of a mating connector. The header has a friction lock wall for securing the mating connector thereto, and force must be applied to the mating connector in order to overcome the friction lock during unmating of the connector from the header. During the unmating, considerable force is transferred to the header by the friction lock, and this force may pull the header housing off of the posts if the housing does not firmly grip the posts. The posts are interference fitted in cavities in the housing, and the interference fit has generally provided a sufficient post retention force. A problem arises when the header is subjected to high temperatures such as occur during surface mount solder reflow assembly processes. The high temperature causes a relaxation of the forces generated by the interference fit. In order to compensate for the relaxation, the amount of initial interference fit must be increased so that a sufficient post retention force remains after the solder reflow process. However, increasing the interference fit can result in cracks in the housing around the contact posts and an accompanying loss of retention force. There is a need for an inexpensive solution to this problem.

SUMMARY OF THE INVENTION

The invention is an electrical header comprising a dielectric housing having cavities and contact posts held in the cavities. The contact posts extend beyond a first face of the housing for attachment to a substrate and extend beyond a second face of the housing for engagement with contacts of a mating electrical connector. Each of the contact posts has an enlargement in a vicinity of the second face. The enlargement has a width which is greater than a width of its corresponding said cavity for preventing the housing from being pulled off of the contact posts when the contact posts are attached to the substrate.

In one embodiment, the housing has recesses in the second face leading to the cavities, and the enlargements are disposed in the recesses inward from the second face. The recesses may be tapered as they extend inward from the second face.

BRIEF DESCRIPTION OF THE DRAWINGS

The invention will now be described by way of example with reference to the accompanying drawings wherein.

DETAILED DESCRIPTION OF AN EMBODIMENT OF THE INVENTION

Figure 1:
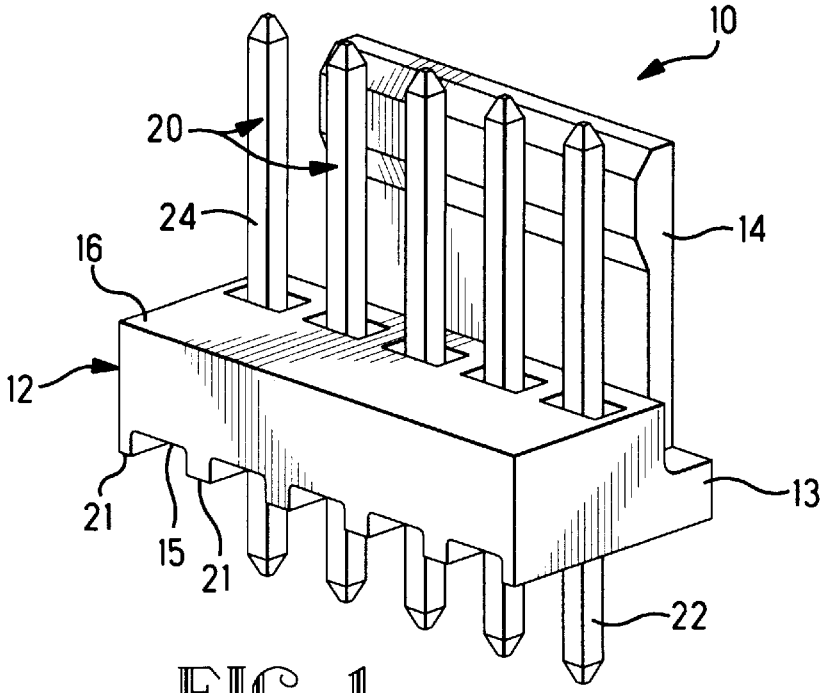
FIG. 1 is an isometric view of an electrical header according to the invention.

There is shown in FIG. 1 an electrical header 10 which is adapted to be mounted on a circuit board or other substrate (not shown). The header 10 comprises a dielectric housing 12 which holds a plurality of contact posts 20 that are aligned in a row along a major axis of the housing. The housing 12 includes a base portion 13 and a friction lock wall 14. The posts 20 have exposed portions 22 which extend beyond a first face 15 of the housing for attachment to the circuit board, and exposed portions 24 which extend beyond a second face 16 of the housing for engagement with contacts of a mating electrical connector. It should be noted that the exposed portions 22 need not be straight as shown but instead may include a bend at some angle as long as the exposed portions 22 are available for attachment to a circuit board. The housing also has a plurality of standoff ribs 21 extending from the first face 15 which elevate the first face above the circuit board.

Figure 2:
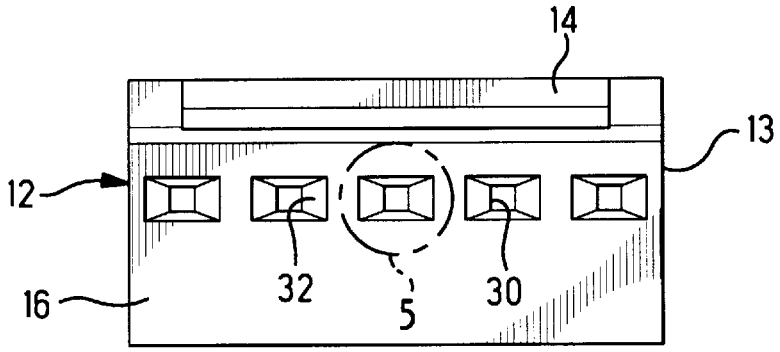
FIG. 2 is a top view of a housing for the header.
Figure 3:
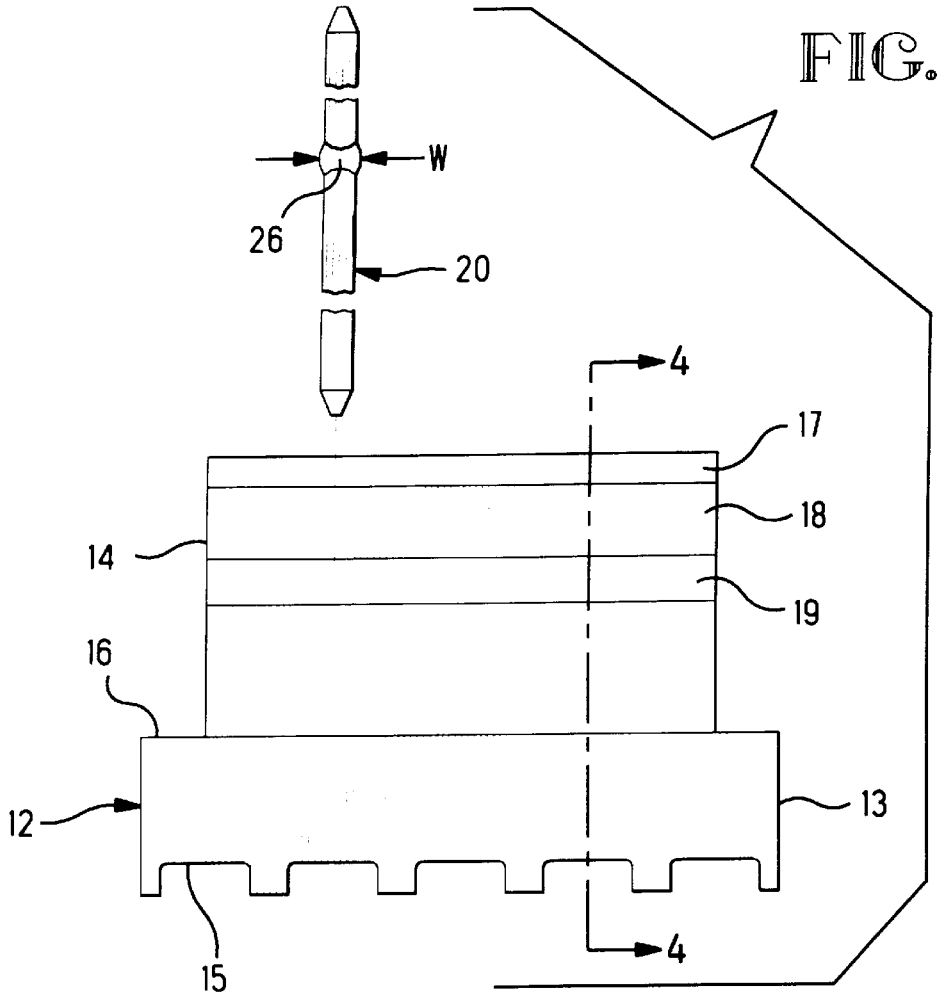
FIG. 3 is a front view of the housing and a contact post disposed for insertion in the housing.
Figure 4:
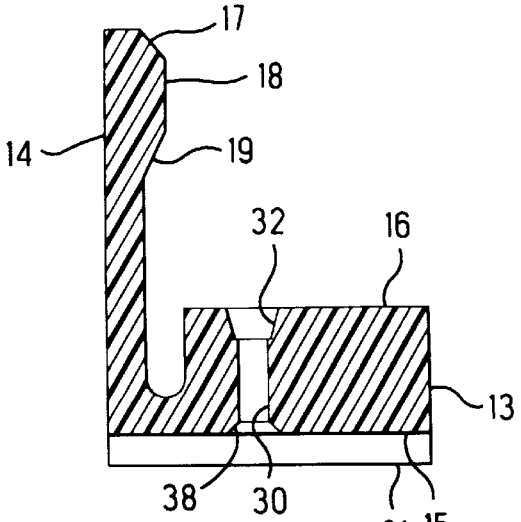
FIG. 4 is a cross-sectional view taken along line 4—4 of FIG. 3.

With reference to FIGS. 2–4, the posts 20 are held in respective cavities 30 in the base portion 13 of the housing 12. Each of the cavities 30 is dimensioned to hold one of the posts in an interference fit. As shown in FIG. 2, each of the cavities 30 has a square cross- sectional shape to accommodate a square cross-sectional portion of one of the posts, although other cross-sectional shapes, such as rectangular or circular, for either or both of the cavities and the posts are considered to be within the scope of the invention.

Figure 6:
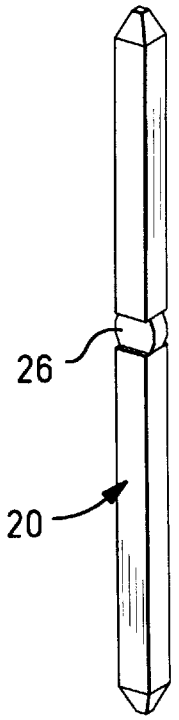
FIG. 6 is an isometric view of a contact post that is used with the header.

According to the invention, each of the posts 20 has an enlargement 26, shown in FIGS. 3 and 6, with a width W which is greater than a width of the cavity which receives that post. The enlargement 26 may be provided by deforming a portion of the post in a stamping operation. The posts are installed in their cavities through the second face 16 of the housing and the enlargements 26 become disposed in a vicinity of the second face.

With reference to FIG. 4, the housing preferably has recesses 32 in the second face 16 leading to the cavities 30. The posts are installed in the cavities and the enlargements 26 are disposed in the recesses inward from the second face so that the enlargements do not interfere with any portion of the mating electrical connector.

Figure 5:
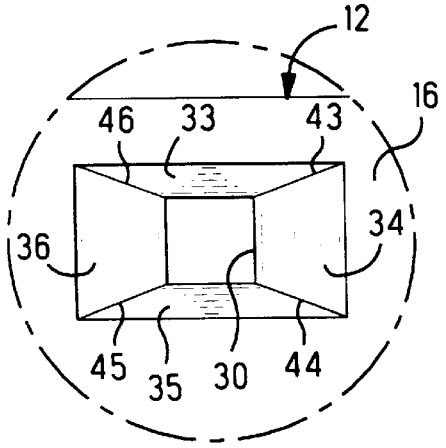
FIG. 5 is an enlarged view of detail 5 shown in FIG. 3.

According to another aspect of the invention, the recesses 32 are tapered in size as they extend inward from the second face 16 to their cavities 30. As shown in detail in FIG. 5, the recess has a rectangular shape with four wall surfaces 33,34,35,36 which incline from the second surface 16 to the walls of the cavity 30. When the housing is made from a molded plastic material, intersections between the inclined walls 33,34,35,36 form mold lines 43,44,45,46 which are directed at respective angles to the major axis of the housing 12. These mold lines 43,44,45,46 help to distribute throughout the housing the forces which arise due to the interference fit of the posts 20 in the cavities 30, thereby reducing the tendency of the housing to crack along the grain of the plastic.

At an opposite end of each of the cavities 30, a recess 38 (shown in FIG. 4) can be provided with inclined walls similar to the walls of the recess 32, thereby further distributing the interference fit forces throughout the housing.

Referring again to FIG. 4, the friction lock wall 14 is cantilevered from the base 13 and is slightly deflectable. The friction lock wall has a projection 18 with inclined ramp surfaces 17 and 19. A mating connector (not shown) is secured to the header by the projection 18 which enters a pocket of the mating connector. In order to decouple the mating connector from the header, the mating connector is withdrawn vertically along the axes of the posts 20. During this withdrawal, a surface of the mating connector engages the ramp 19 and deflects the projection 18 laterally, thereby imposing significant vertical forces on the housing 12. If the interference fit between the cavities and the posts is insufficient to hold the housing on the posts, the enlargements 26, being wider than the cavities, will be engaged by the inclined walls of the recesses 32. Thus, the recesses 32 provide an assured means for preventing the housing from being pulled off of the posts.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1.An electrical header comprising:

a dielectric housing having cavities and contact posts held in the cavities, the contact posts extending beyond a first face of the housing for attachment to a substrate and extending beyond a second face of the housing for engagement with contacts of a mating electrical connector, the housing having recesses in the second face leading to the cavities, each of the recesses being coaxial with a respective one of the cavities, each of the contact posts having an enlargement which is disposed in one of the recesses inward from the second face, each of the enlargements having a width which is greater than a width of its corresponding said cavity for preventing the housing from being pulled off of the contact posts when the contact posts are attached to the substrate.

2. The electrical header of claim 1 wherein the contact posts are interference fitted in their said cavities.

3. The electrical header of claim 1 wherein each of the contact posts has a square cross-section.

4. The electrical header of claim 1 wherein the enlargement is provided by a deformed section of the contact post.

5. The electrical header of claim 1 wherein the recesses are tapered as they extend from the second face to the cavities.

6. The electrical header of claim 5 wherein each of the recesses has a plurality of walls, and intersections between the walls form mold lines which are directed at respective angles to a major axis of the housing.

7. The electrical header of claim 5 wherein the housing has recesses in the first face leading to the cavities, and the recesses are tapered as they extend from the first face to the cavities.

* * * * *